United States Patent [19]

Siwula

[11] 4,290,708

[45] Sep. 22, 1981

[54] ATTACHABLE MICROPROCESSORS

[76] Inventor: John T. Siwula, 145 Sanford Dr., Jamestown, N.Y. 14701

[21] Appl. No.: 931,382

[22] Filed: Aug. 7, 1978

[51] Int. Cl.[3] ..... F16B 1/00

[52] U.S. Cl. ..... 403/24; 235/1 D

[58] Field of Search ..... 364/705; 235/1 D; 73/431; 403/24, 25

[56] References Cited

U.S. PATENT DOCUMENTS

| | | | |
|---|---|---|---|
| 2,046,810 | 7/1936 | Cannon | 235/1 D |
| 2,372,650 | 4/1945 | Bliss | 235/1 D |
| 3,201,992 | 8/1965 | Hoff, Jr. | 73/431 X |
| 3,265,297 | 8/1966 | Behrens | 235/1 D |
| 4,020,527 | 5/1977 | O'Neill | 235/1 D X |
| 4,075,702 | 2/1978 | Davies | 364/705 |

*Primary Examiner*—Andrew V. Kundrat
*Attorney, Agent, or Firm*—Christel, Bean & Linihan

[57] ABSTRACT

A microprocessor which is attachable to any object such as a checkbook, folder or notebook by fastening means extending from an attachable surface of the microprocessor housing. In one form the fastening means includes a plurality of elongated fastening elements each connected to the microprocessor housing and extending generally perpendicular from the housing attachable surface for connection to the object. In another form the fastening means includes a clip connected at one end to microprocessor housing and extending along the housing attachable surface to receive a portion of the object between the clip and housing to hold the microprocessor and object together.

5 Claims, 8 Drawing Figures

ATTACHABLE MICROPROCESSORS

CROSS-REFERENCES

U.S. Pat. No. 4,075,702 issued in 1978 refers to a microprocessor fastened to a checking folder. In contrast, the attachable microprocessor is not intended to be manufactured in a condition in which it is attached to anything but rather in a condition which would allow its attachment to any object the owner chooses to attach it to.

DESCRIPTION OF THE PRIOR ART AND SUMMARY OF THE INVENTION

This invention relates to an attachable microprocessor for providing a means whereby the owner of the microprocessor could attach it to any object of his choosing. Physical usage of microprocessors can sometimes be difficult depending on the location of the microprocessor in relation to the user. For example, during an airplane flight, a busy accountant or executive may have to work with his microprocessor. Such a situation would possibly require that the microprocessor be held in both hands with his notes resting on his lap. This portrays one of many clumsy and potentially harmful situations resulting from an individual trying to simultaneously handle his microprocessor and other essential material. Such situations are inconvenient and can possibly result in damage either to the microprocessor or other essential material and consequently irritate the operator of the microprocessor. Situations such as this could be alleviated and the individual's work task facilitated if the microprocessor could be attached to the notebook. Likewise, many holders of checking accounts would like to be able to attach their microprocessors to their checking folder without having to go out and purchase a new checking folder with attached microprocessor. The attachable microprocessor would allow the holder of a checking account to do this. Many other tasks could also be facilitated by the use of attachable microprocessors.

DETAILED DESCRIPTION OF THE DRAWINGS

Figure 2:
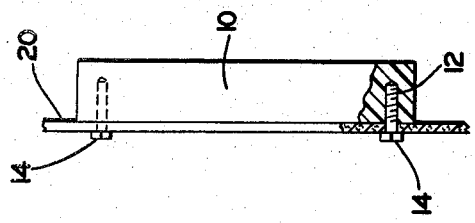
FIG. 2 is a side view of the same microprocessor with tapped holes depicted in FIG. 1.
Figure 1:
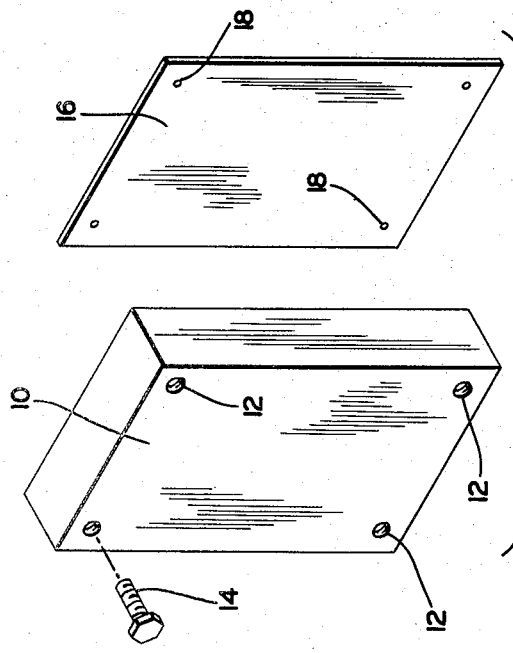
FIG. 1 is a rear view of a microprocessor with tapped holes.

Reference is now made to FIGS. 1 and 2 which illustrate the housing of a microprocessor 10 with holes 12 tapped in the rear. The purpose of the tapped holes 12 would be to receive the bolts, screws 14, or any attaching device which would pass through an object 20 (notebook, etc.) and function in fastening the microprocessor 10 to the object. FIG. 2 is a side view of the aforementioned and described device. Such a microprocessor could be accompanied by a template 16 with holes 18 corresponding to the tapped holes 12 of the microprocessor 10. The user would place the template 16 on the object 20 he wishes to fasten the microprocessor 10 to and mark the position of the holes. After marking the position of the holes, holes would be punched in the object 20 the owner wants to fasten his microprocessor 10 to. The screws, bolts, rivets, or any appropriate attaching device 14 would then be passed through the object 20 and screwed into the microprocessor 10 thereby fastening the microprocessor 10 to the object 20.

Figure 3:
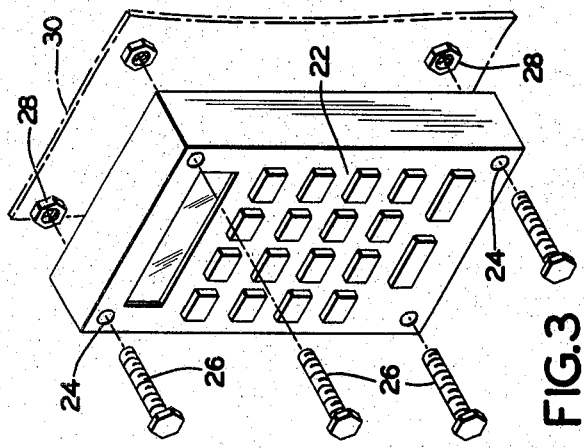
FIG. 3 is a front view of a microprocessor with holes passing completely through the housing.

Reference is now made to FIG. 3 which illustrates a microprocessor 22 having holes 24 passing entirely through the housing. Such holes could receive screws, bolt-nut combinations, rivets or any suitable attaching device 26 by the use of which the owner of the microprocessor could fasten his microprocessor to any object of his choosing. In case of a bolt-nut combination, the nut 28 could fasten to the side of the object 30 opposite the microprocessor 22.

Figure 4:
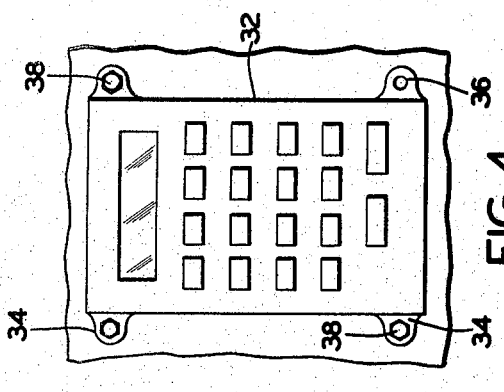
FIG. 4 is a front view of a microprocessor with housing extentions having holes for attachments purposes.

FIG. 4 refers to a microprocessor 32 having housing modifications with attached extensions 34 having holes 36 allowing the passage of screws, rivets, bolt-nut combinations, or any suitable attaching device 38 which would also allow the owner of a microprocessor to fasten that microprocessor to any object he wishes.

Figure 5:
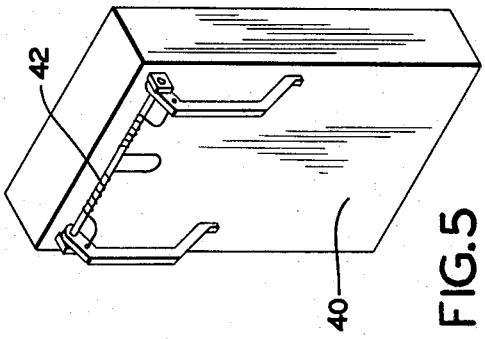
FIG. 5 is a rear-side view of a microprocessor with a spring-loaded clip.

FIG. 5 refers to a microprocessor 40 with a spring-loaded clip 42 which would allow the owner of such a microprocessor a quick and easy means of attaching and removing his microprocessor from objects he deems suitable for such a purpose.

Figure 6:
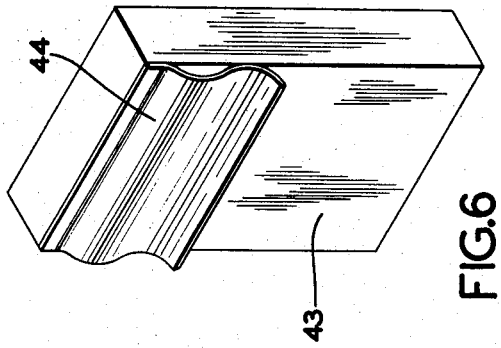
FIG. 6 is a rear-side view of a microprocessor with attachment clip.

Reference is now made to FIG. 6 which illustrates a microprocessor 43 with a clip 44 that also allows quick attachment and removal of the microprocessor from objects deemed suitable by the owner of the microprocessor.

Figure 7:
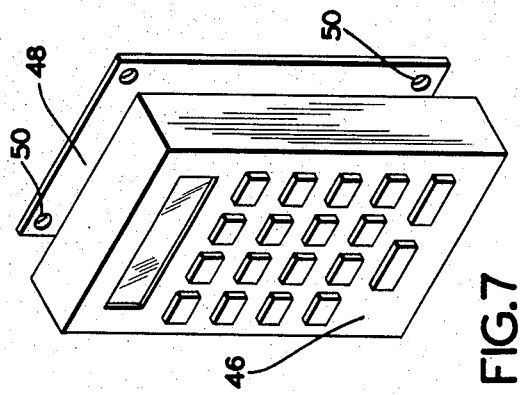
FIG. 7 is a front-side view of a microprocessor with a detachable back plate with holes for accepting bolt-nut combinations, screws, rivets, or any attaching device.

FIG. 7 illustrates a microprocessor 46 with a housing having a detachable rear plate 48 which has holes 50 to accept screws, rivets, bolt-nut combinations or any device which would allow the user of the microprocessor to fasten the microprocessor 48 to the object of his choosing. The owner of the microprocessor could remove the rear plate of the housing 46, mark the position of the holes of the microprocessor 46 on the object he wishes to attach it to, punch holes or drill lead holes in the object, fasten the back plate to the object, and then snap the remainder of the microprocessor 46 back onto the rear plate.

Figure 8:
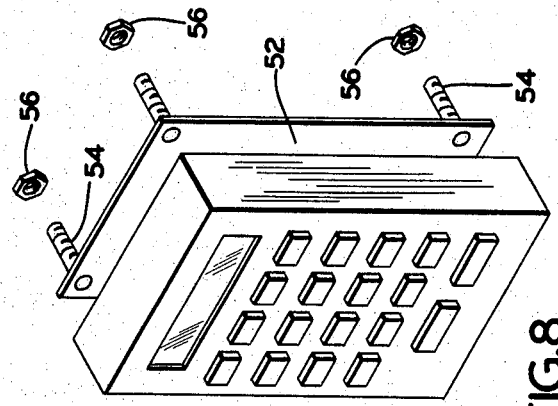
FIG. 8 is a front-side view of a microprocessor with a back plate having attached bolts.

FIG. 8 illustrates a microprocessor that has bolts or threaded rods 54 attached to it. The owner of such a microprocessor would simply mark the position of the bolts 54 on the object he wishes to attach it to, punch holes in the object, pass the bolts 54 of the microprocessor through the object and complete the fastening process by fastening nuts 56 on the bolts.

Many changes and modifications in the above described embodiment of the invention can of course be carried out without departing from the scope thereof. Accordingly, that scope is intended to be limited only by the scope of the appended claims. What is claimed is:

1. An attachable microprocessor comprising the combination of:

(a) a microprocessor having a housing including a generally planar surface attachable to a separate object; and (b) fastening means including a plurality of elongated fastening elements each connected to said microprocessor housing and extending therefrom in a direction generally perpendicular to the plane of said housing surface for connection to said object, each of said elongated fastening elements being of sufficient length and having such a cross sectional shape which enables it to be received in an opening provided in said object for securement to said object when in said opening, and each of said fastening elements being readily removable from said object and said microprocessor housing in a manner which is non-destructive to said fastening elements, object and microprocessor housing;

(c) whereby said fastening means attaches said microprocessor to said object in a manner such that said housing surface faces toward said object;

(d) said housing surface is defined by a plate removably secured to said microprocessor housing and provided with a plurality of formations to recieve and engage said fastening elements.

2. An attachable microprocessor comprising the combination of:

(a) a microprocessor having a housing including a generally planar surface attachable to a separate object;

(b) fastening means including a plurality of elongated fastening elements each connected to said microprocessor housing and extending therefrom in a direction generally perpendicular to the plane of said housing surface for connection to said object, each of said fastening elements comprising a screw adapted to engage said object at one end of said screw and threaded at the other end thereof into a bore provided in said microprocessor housing;

(c) a plurality of bores provided at spaced locations about the periphery of said housing; and (d) a template with holes corresponding to said bores for use in marking corresponding bores on said object for connection of said screws to said object;

(e) whereby said fastening means attaches said microprocessor to said object in a manner such that said housing surface faces toward said object.

3. An attachable microprocessor comprising the combination of:

(a) a microprocessor having a housing including a generally planar surface attachable to a separate object; and (b) fastening means including a plurality of elongated fastening elements each connected to said microprocessor housing and extending therefrom in a direction generally perpendicular to the plane of said housing surface for connection to said object, each of said fastening elements comprising a bolt and nut combination, said bolt extending through a bore provided through said microprocessor housing and through a corresponding hole provided in said object, said nut being threaded on the end of said bolt in a manner such that said microprocessor housing and said object are held together;

(c) whereby said fastening means attaches said microprocessor to said object in a manner such that said housing surface faces toward said object.

4. An attachable microprocessor comprising the combination of:

(a) a microprocessor having a housing including a generally planar surface attachable to a separate object;

(b) fastening means including a plurality of elongated fastening elements each connected to said microprocessor housing and extending therefrom in a direction generally perpendicular to the plane of said housing surface for connection to said object; and (c) a plurality of extensions each provided with a hole to receive said fastening element and each extending from said housing in a plane generally parallel to the plane of said housing surface;

(d) whereby said fastening means attaches said microprocessor to said object in a manner such that said housing surface faces toward said object.

5. An attachable microprocessor comprising the combination of:

(a) a microprocessor having a housing including a generally planar surface attachable to a separate object; and (b) fastening means including a plurality of elongated fastening elements each connected to said microprocessor housing and extending therefrom in a direction generally perpendicular to the plane of said housing surface for connection to said object, each of said fastening elements comprising a threaded bolt fixed at one end to said microprocessor housing adapted to extend through an opening in said object and having a nut for threading onto the other end thereof in a manner engaging said object to hold said microprocessor housing and said object together;

(c) whereby said fastening means attaches said microprocessor to said object in a manner such that said housing surface faces toward said object.

* * * * *